US005779390A

United States Patent [19]

Tuusinen

[11] Patent Number: 5,779,390

[45] Date of Patent: Jul. 14, 1998

[54] DEVICE FOR LEVELLING A LAYER OF SAND

[76] Inventor: Jukka Tapani Tuusinen, Tervatie 3, Fin-35990 Kolho, Finland

[21] Appl. No.: 704,596

[22] PCT Filed: May 2, 1995

[86] PCT No.: PCT/FI95/00235

§ 371 Date: Sep. 13, 1996

§ 102(e) Date: Sep. 13, 1996

[87] PCT Pub. No.: WO95/30051

PCT Pub. Date: Nov. 9, 1995

[30] Foreign Application Priority Data

Apr. 29, 1994 [FI] Finland ..... 941985

[51] Int. Cl.[6] ..... E01C 19/12; E01C 23/06

[52] U.S. Cl. ..... 404/101; 404/119; 404/120

[58] Field of Search ..... 404/96, 101, 105, 404/106, 110, 119, 114, 118, 120

[56] References Cited

U.S. PATENT DOCUMENTS

| | | | |
|---|---|---|---|
| 2,065,698 | 12/1936 | Heltzel | 404/101 |
| 2,224,084 | 12/1940 | Mills et al. | 404/101 |
| 5,599,135 | 2/1997 | Delaurenti | 404/101 |

*Primary Examiner*—James Lisehora
*Attorney, Agent, or Firm*—Fildes & Outland, P.C.

[57] ABSTRACT

A device for levelling a sand layer (1) at the landing place of various jumping events, which device includes rails (2) on either side of the sand layer and a trolley (3) travelling back and forwards on them, which in turn includes at least a rake member (4) for loosening the sand layer, a sand-moving member (5.1, 5.2) for filling pits, and a levelling member (6) for levelling the loosened sand layer, as well as devices for moving these in a vertical direction. The sand-moving member consists of several parallel V-ploughs (5.1) pointed in the opposite direction to the levelling direction and a transverse bar (5.2) or similar together with support devices, moving after the rake member (4).

7 Claims, 3 Drawing Sheets

DEVICE FOR LEVELLING A LAYER OF SAND

The object of the invention is a device for levelling a layer of sand as a landing place for various jumping events, which device includes rails on either side of the sand layer and a trolley moving backwards and forwards along them and which further includes at least a rake member for loosening the sand layer, a sand-moving member for filling pits, and a levelling member for levelling the loosened sand layer, as well as devices for moving these in a vertical direction.

During a competition the surface of the landing place is depressed after the jumper has left it and as a result of the footprints of the measurers. This happens especially when the sand is damp in rainy weather. Because a jumper strikes the landing place at an angle of about 45°, every change in the level of the landing place causes a difference in the length of the jumps. If the depressed surface is raised to the zero level by adding sand, then the jumper who jumps immediately after the raising suffers most from this. This being the case, it is of absolute importance when determining the correct length of a jump that the surface of the landing place is at the same level for each jump for the entire duration of the competition.

One kind of sand layer levelling device is known from German patent application DE 2 448 830, which consists of a rake member and a levelling member. The rake member consists of pins or plate members set in two transverse rows and which extend deep into the sand layer. The rows of this kind are pulled over the sand layer, when the sand layer becomes thoroughly loosened. After these comes a levelling member, formed by a transverse plate, which ploughs the mass over the surface to be levelled forwards, leaving a level surface. A slightly modified sand layer levelling device is known from Finnish patent 76395, which also consists of sand moving and levelling devices attached to a trolley. The moving member consists of a plough-like member, which can be moved laterally at the location of a pit. The levelling member is hinged in such a way that when it moves in the opposite direction it follows the uneven surface of the sand layer and operates only when the trolley is moved in the levelling direction. Both of the aforementioned devices are principally intended for manual operation, even though in the Finnish application reference is made to possible mechanical operation. They are not, however, very suitable for mechanical operation, because the trolley can rise over uneven sand. In any event, the device in accordance with the Finnish patent demands visual estimation of the location of a pit, at which the sand moving member should be set in a lateral direction.

It is the intention of this invention to create an easily mechanized, efficient, and reliable sand layer levelling device. The characteristic features of the invention are presented in the accompanying Patent claims.

According to the invention it is precisely a rake member that is used, even though it demands relatively great power. In mechanical operation this is no drawback, but by means of a rake member efficient loosening and lightening of the sand is achieved, when compaction is minimized during a competition.

In what follows the invention is illustrated with reference to the accompanying Figures, which show one levelling device in accordance with the invention.

Figure 1:
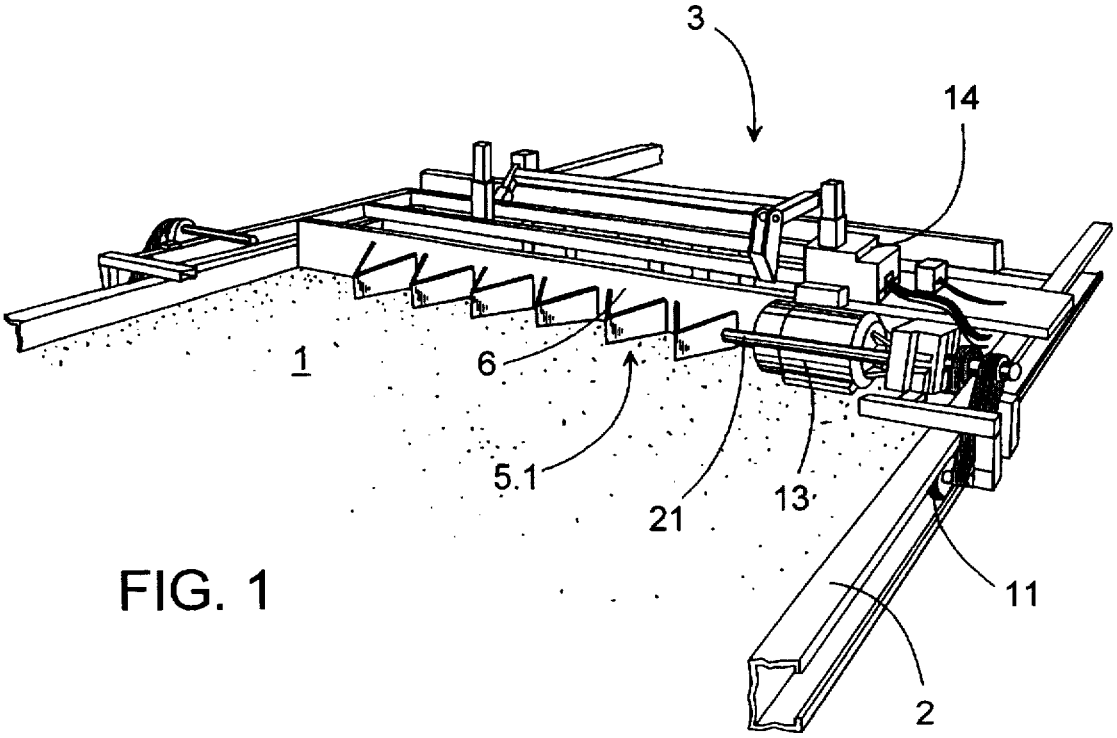
FIG. 1 shows the levelling device seen from in front.
Figure 2:
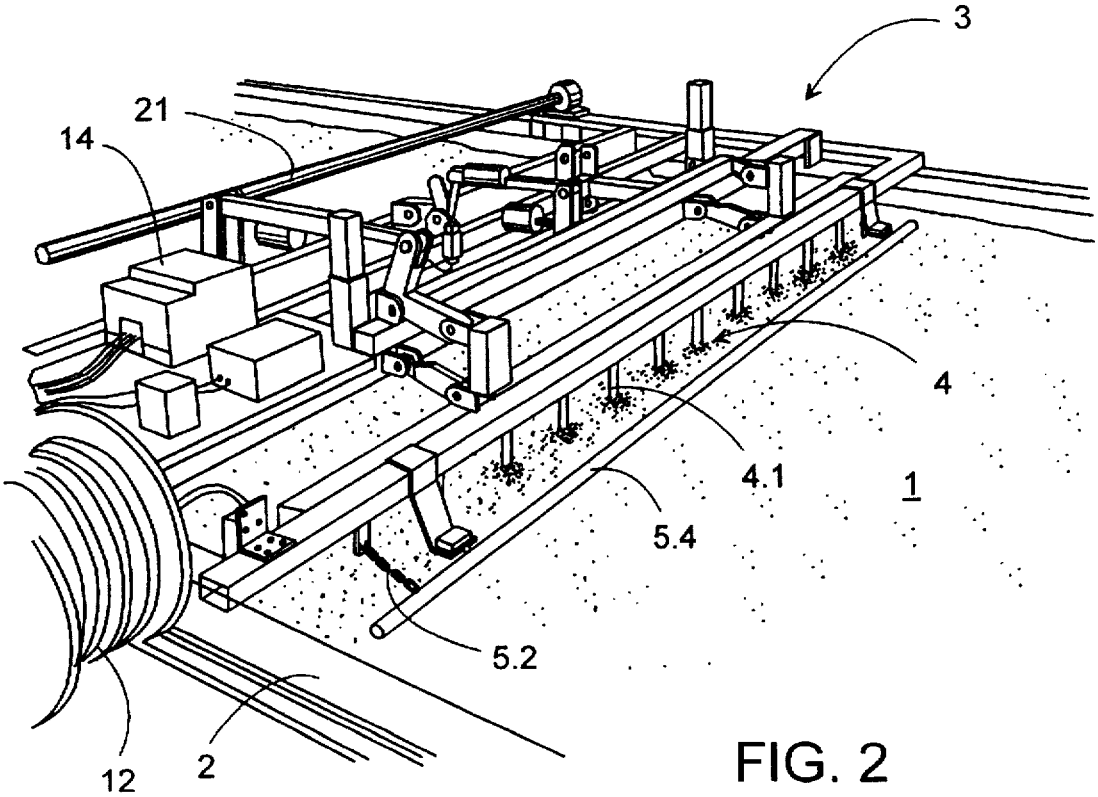
FIG. 2 shows the levelling device seen from the rear.
Figure 3:
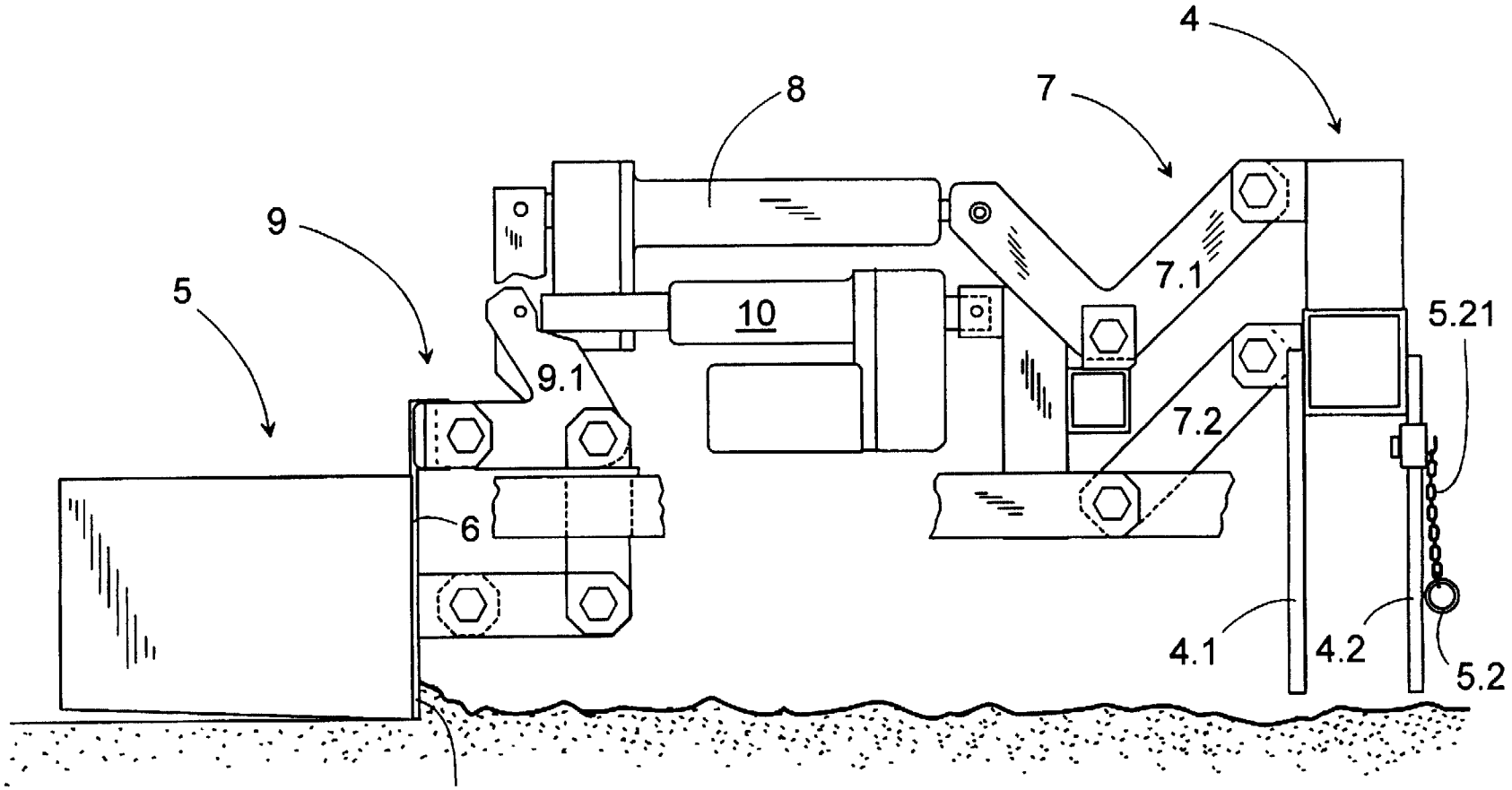
FIG. 3 shows the lifting devices of the rake and moving members seen from the side.

In FIGS. 1 and 2 the sand layer is marked with reference number 1, the rails with reference number 2, and the trolley itself with reference number 3. The support wheels of the trolley run inside a C-profile rail, so that they are not able to rise, even under the greatest loading. The first moving member 5.1, which is composed of several plough-like members, is in the front of the device and the rake member 4 is behind the device. The plough-like members 5.1 are attached to a plate, the lower edge of which forms the levelling member 6. Bar 5.2, which forms the second moving member, is attached by means of chains 5.21 to the rake member. The spikes of the rake member 4 leave deep furrows in the surface, so that moving member 5.2 acts as an effective pre-leveller. All the operating devices are powered by electricity, so that the trolley includes a spring reel 12 for this purpose, which pulls the cable tight and makes possible the supply of electricity to the moving trolley. The trolley includes a control unit 14 for controlling the various operations and an operating motor 13 with a transmission for moving the trolley.

The raising of the rake members and moving members is carried out with the aid of parallelogram arms 7 and 9. These are driven by electric spindle motors 8 and 10. The spikes 4.1 and 4.2 of the rake member are attached to a beam, which in turn is attached to the frame by means of parallelogram arms 7.1 and 7.2. The upper parallelogram arm is driven by the aforesaid spindle motor 8. The first moving member 5.1, which is composed of parallel V-ploughs, is attached to plate 6.1. The lower edge of this forms the levelling member 6 proper. The V-ploughs themselves do not at their points extend quite as far down as the levelling member 6.

Figure 4:
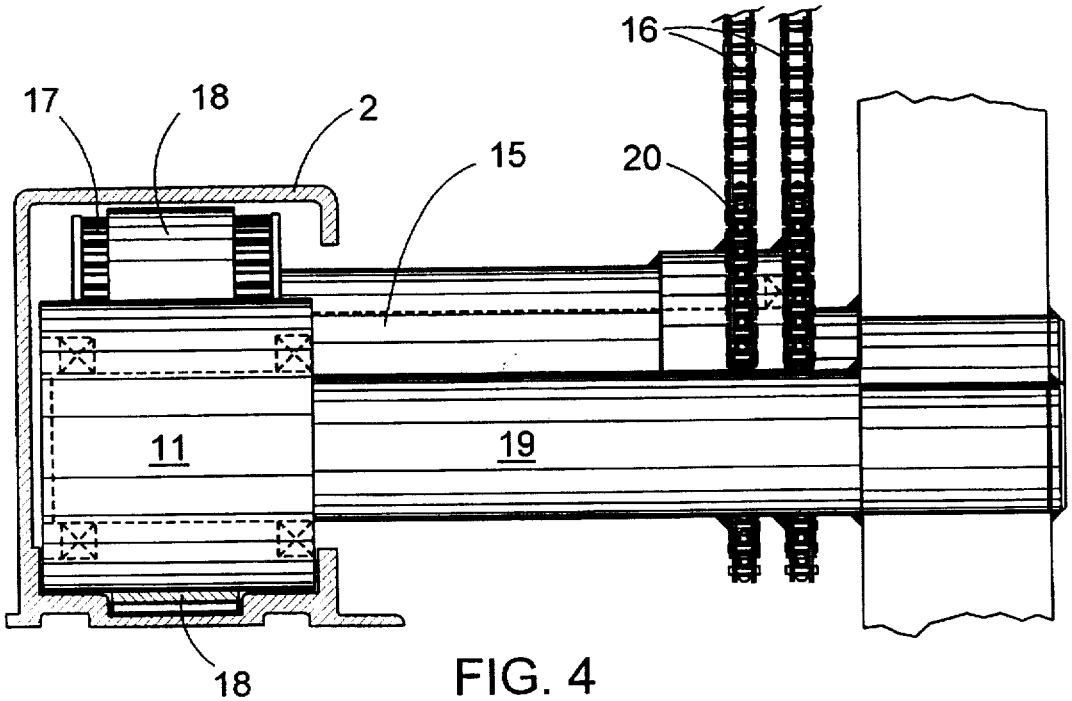
FIGS. 4 and 5 show the arrangement of the support and drive wheels of the trolley.
Figure 5:
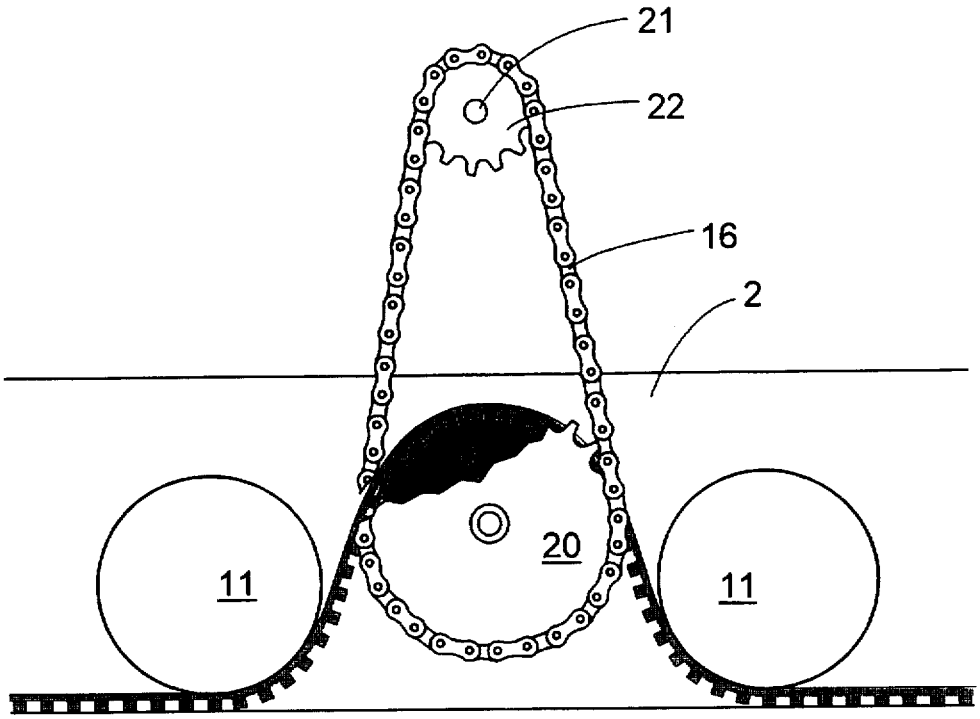

The gearbox rotated by the operating motor 13 in turn drives axle 21, which rotates double chainwheels 22, FIGS. 4 and 5. These transmit the drive through chain 16 and chainwheels 20 to axle 15, which rotates cogged belt wheel 17. Axle 15 is attached to the frame with bearings. The cogged belt 18 is located in the groove in the base of beam 2 beneath the support wheels 11. Between them it is led over the aforementioned cogged belt wheel 17. Because the cogged belt 18 is attached by the ends to the ends of the rail, there is no slip and movement of the trolley is ensured. The support wheels 11 are attached by bearings to beam 19, which is welded to the frame of the trolley.

The levelling device is operated as follows. In FIG. 1 both the rake member and the moving member are in the lowered position and the trolley is moved towards the viewer. FIG. 2 shows the situation seen from the other side. The rake member 4 and the second moving member 5.2 are in operation. When they leave the home station both are in the upper position, but are lowered in the area of the sand layer. When the trolley has nearly crossed the field both are raised, the moving member first of all, however. In the return stage, the levelling member is lowered to the desired height and then driven over the entire field, when the sand layer is levelled. Close to the rear station the levelling member too is raised and driven to the home station.

I claim:

1. A device for levelling a sand layer at the landing place of various jumping events, the device including rails on either side of the sand layer and a trolley travelling back and forwards on the rails, the trolley including a rake member for loosening the sand layer, a sand-moving member for filling pits, and a levelling member for levelling the loosened sand layer, as well as devices for moving said rake, sand moving and levelling members in a vertical direction, characterized in that the sand-moving member comprises several laterally spaced V-ploughs pointed in the opposite direction to the levelling direction and a transverse bar together with support devices, moving after the rake member.

2. A device in accordance with claim 1, characterized in that the levelling member comprises a vertical plate carrying the V-ploughs, the lower edge of which levels the sand layer during the return movement of the trolley.

3. A device in accordance with claim 1, characterized in that said bar behind the rake member is attached to the rake member by chains.

4. A device in accordance with claim 1, characterized in that the trolley includes a mechanical driving device for moving it and a spring reel for leading a cable transmitting operating power to the trolley moving backwards and forwards.

5. A device in accordance with claim 1, characterized by devices for moving the rake member in a vertical direction comprising parallelogram arms that are hinged, and operating devices for driving the parallelogram arms.

6. A device in accordance with claim 1, characterized in that the rails are arranged to prevent the support wheels from rising even under a great loading.

7. A device in accordance with claim 6, characterized in that both rails include in combination two support wheels set in line next to one another and a cogged belt located in a groove in the bottom of the rail, which is threaded over a drive wheel between these support wheels, wherein the trolley is made moveable by rotating the drive wheel.

* * * * *